US007088328B2

(12) United States Patent
Inada et al.

(10) Patent No.: US 7,088,328 B2
(45) Date of Patent: Aug. 8, 2006

(54) LIQUID CRYSTAL DISPLAY DEVICE HAVING A CIRCUIT FOR CONTROLLING POLARITY OF VIDEO SIGNAL FOR EACH PIXEL

(75) Inventors: Katsuhiko Inada, Saitama-ken (JP); Yasuyuki Hanazawa, Saitama-ken (JP); Tetsuo Morita, Saitama-ken (JP); Kohei Nagayama, Saitama-ken (JP); Hideyuki Takahashi, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 454 days.

(21) Appl. No.: 10/292,500

(22) Filed: Nov. 13, 2002

(65) Prior Publication Data

US 2003/0090450 A1 May 15, 2003

(30) Foreign Application Priority Data

Nov. 14, 2001 (JP) ..... 2001-348968
May 29, 2002 (JP) ..... 2002-156027

(51) Int. Cl.
*G09G 3/36* (2006.01)

(52) U.S. Cl. ..... 345/96; 345/209

(58) Field of Classification Search ..... 345/204, 345/209, 210, 211, 214, 87–102, 79, 208; 349/38–40, 149–152; G09G 3/36
See application file for complete search history.

(56) References Cited

U.S. PATENT DOCUMENTS 5,748,165 A * 5/1998 Kubota et al. ..... 345/96
5,946,058 A * 8/1999 Kamada et al. ..... 349/42
5,953,088 A * 9/1999 Hanazawa et al. ..... 349/110
6,243,064 B1 * 6/2001 Hirakata ..... 345/96
6,344,885 B1 * 2/2002 Mori et al. ..... 349/44
6,400,427 B1 * 6/2002 Hanazawa et al. ..... 349/44
6,473,077 B1 * 10/2002 Takenaka et al. ..... 345/209
6,538,631 B1 * 3/2003 Kwon ..... 345/96
6,552,706 B1 * 4/2003 Ikeda et al. ..... 345/96
6,750,924 B1 * 6/2004 Murade ..... 349/38
6,781,568 B1 * 8/2004 Nishimura et al. ..... 345/96
2002/0044251 A1 * 4/2002 Togashi et al. ..... 349/149
2003/0030615 A1 * 2/2003 Maeda et al. ..... 345/90
2003/0193493 A1 * 10/2003 Ozawa ..... 345/204
2004/0070581 A1 * 4/2004 Hiraki et al. ..... 345/209

FOREIGN PATENT DOCUMENTS

JP 63068821 A * 3/1988
JP 02026481 A * 1/1990
JP 03172085 A * 7/1991
JP 10032772 A * 2/1998
JP 10-104576 4/1998
KR 1020010080830 A 8/2001

* cited by examiner

*Primary Examiner*—Alexander Eisen
(74) *Attorney, Agent, or Firm*—Oblon, Spivak, McClelland, Maier & Neustadt, P.C.

(57) ABSTRACT

A signal line driving circuit makes the polarities of video signals different from each other, the video signal being supplied to pixel electrodes adjacent to an arbitrary pixel electrode on both sides thereof in a horizontal scanning direction. The signal line driving circuit also makes the polarities of video signals different from each other, the video signal being supplied to pixel electrodes adjacent to the arbitrary pixel electrode on both sides thereof in a vertical scanning direction. A signal line driving IC outputs the video signal to each signal line group obtained by dividing a plurality of signal lines to a plurality of signal line groups composed of a predetermined number of the signal lines. A signal line switching circuit switches all of the signal lines in each signal line group sequentially during one horizontal scanning period.

7 Claims, 13 Drawing Sheets

FIG.7A

VERTICAL SCANNING DIRECTION

| | | | | | | | | |
|---|---|---|---|---|---|---|---|---|
| + | − | − | + | + | − | − | + | + |
| + | + | − | − | + | + | − | − | + |
| − | + | + | − | − | + | + | − | − |
| − | − | + | + | − | − | + | + | − |
| + | − | − | + | + | − | − | + | + |
| + | + | − | − | + | + | − | − | + |
| − | + | + | − | − | + | + | − | − |
| − | − | + | + | − | − | + | + | − |
| + | − | − | + | + | − | − | + | + |

FIG.7B

VERTICAL SCANNING DIRECTION

| | | | | | | | | |
|---|---|---|---|---|---|---|---|---|
| − | + | + | − | − | + | + | − | − |
| − | − | + | + | − | − | + | + | − |
| + | − | − | + | + | − | − | + | + |
| + | + | − | − | + | + | − | − | + |
| − | + | + | − | − | + | + | − | − |
| − | − | + | + | − | − | + | + | − |
| + | − | − | + | + | − | − | + | + |
| + | + | − | − | + | + | − | − | + |
| − | + | + | − | − | + | + | − | − |

FIG.9A

VERTICAL SCANNING DIRECTION

| | | | | | | | | |
|---|---|---|---|---|---|---|---|---|
| + | + | − | − | + | + | − | − | + |
| + | − | − | + | + | − | − | + | + |
| − | − | + | + | − | − | + | + | − |
| − | + | + | − | − | + | + | − | − |
| + | + | − | − | + | + | − | − | + |
| + | − | − | + | + | − | − | + | + |
| − | − | + | + | − | − | + | + | − |
| − | + | + | − | − | + | + | − | − |
| + | + | − | − | + | + | − | − | + |

FIG.9B

VERTICAL SCANNING DIRECTION

| | | | | | | | | |
|---|---|---|---|---|---|---|---|---|
| − | − | + | + | − | − | + | + | − |
| − | + | + | − | − | + | + | − | − |
| + | + | − | − | + | + | − | − | + |
| + | − | − | + | + | − | − | + | + |
| − | − | + | + | − | − | + | + | − |
| − | + | + | − | − | + | + | − | − |
| + | + | − | − | + | + | − | − | + |
| + | − | − | + | + | − | − | + | + |
| − | − | + | + | − | − | + | + | − |

LIQUID CRYSTAL DISPLAY DEVICE HAVING A CIRCUIT FOR CONTROLLING POLARITY OF VIDEO SIGNAL FOR EACH PIXEL

CROSS-REFERENCE TO RELATED APPLICATIONS

This application is based upon and claims the benefit of priority from Japanese Patent Application No. 2001-348968 filed Nov. 14, 2001 and No. 2002-156027 filed May 29, 2002; the entire contents of which are incorporated herein by reference.

BACKGROUND OF THE INVENTION

1. Field of the Invention

The present invention relates to an active matrix type liquid crystal display device in which a pixel is disposed at each intersection portion of a plurality of signal lines and a plurality of scanning lines, and a pixel electrode and a transistor are disposed at each pixel.

2. Description of Related Art

A vertical (V) lines inversion driving method and a Vertical/Horizontal (V/H) lines inversion driving method have been generally known as methods for writing a video signal to each pixel electrode in an active matrix liquid crystal display device.

As shown in FIGS. 1A and 1B, in the V-lines inversion driving method, each of the video signals having a polarity inverted for each signal line wired in parallel to a vertical scanning direction is written to each pixel. When scanning shifts from an arbitrary n-th frame to an (n+1)-th frame, the polarity of video signal in each pixel is inverted. Specifically, the polarity of video signal in each pixel is inverted each vertical scanning period. In FIGS. 1A and 1B, the symbol "+" indicates a positive polarity pixel, and the symbol "−" indicates a negative polarity pixel. In the V-lines inversion driving method, when a common potential is set to, for example, 5V, a voltage of 9V is applied to positive polarity pixels, and a voltage of 1V is applied to negative polarity pixels.

As shown in FIGS. 2A and 2B, in the H/V-lines inversion driving method, the polarity of a video signal is inverted for each signal line, and the polarity of the video signal is inverted for each scanning line. When scanning shifts from an n-th frame to an (n+1)-th frame, the polarity of the video signal in each pixel is inverted.

However, in the V-lines inversion driving method, when the potential at the signal line varies for some reason, the potential at the pixel electrode is varied due to the existence of coupling capacitance between the signal line and the pixel electrode. Moreover, the polarity of a certain pixel and the polarity of each of two pixels adjacent to the certain pixel in a horizontal scanning direction are opposite for each other. Therefore, when a rectangular complementary color window pattern is displayed at the center of a screen with a halftone color used as a background color, an amount of a potential variation at each pixel electrode differs from one pixel to another. As a result, the gradation of a halftone color luster of the window pattern differs in its right and left portions thereof as well in its upper and lower portions thereof, causing display unevenness called vertical cross talk.

In the H/V-lines inversion driving method, the polarity of the video signal is inverted each horizontal scanning period to cope with such a situation. Since the inversion of the polarity of the video signal cancels the potential variation at each pixel electrode each horizontal scanning period, the vertical cross talk can be reduced. However, the cycle for inverting the polarity of the video signal is short, and power consumption is increased.

A final screen of Windows (trade mark) adopted as an OS for many personal computers is a checkered pattern expressing black display pixel groups and halftone display pixel groups alternately as shown in FIGS. 3A and 3B. With respect to the halftone display pixels, while the number of negative polarity pixels is larger than that of positive polarity pixels in the n-th frame of FIG. 3A, the number of positive polarity pixels is larger than that of negative polarity pixels in the (n+1)-th frame of FIG. 3B. Thus, polarity deflection occurs in the halftone display pixels, and brightness differs between positive polarity pixels and negative polarity pixels. Accordingly, this deflection is prone to be visible as flicker. The number of the positive polarity pixels and the number of the negative polarity pixels in the halftone display differ from each other in each scanning line, causing polarity deflection in this direction. For this reason, horizontal cross talk may occur due to influences of potential variations at opposed electrodes formed on the surface of an opposed substrate which is disposed so as to face an array substrate where pixel electrodes, signal lines and the like are formed.

Incidentally, in the active matrix liquid crystal display device, a pixel transistor is formed for each pixel, and a liquid crystal display device using an amorphous thin film transistor (TFT) or a polycrystalline silicon TFT as the pixel transistor has been known.

In the liquid crystal display device using the amorphous silicon TFT, a tape carrier package (TCP) in which a signal line driving circuit and a scanning line driving circuit are formed on a flexible wiring substrate is used. When the TCP is connected electrically to a connection terminal of the array substrate, the signal driving circuit is connected to pixel transistors via signal lines and the scanning driving circuit is connected to pixel transistors via scanning lines on the array substrate.

In the liquid crystal display device using the amorphous silicon TFT, wirings for outputting the video signals from the TCP onto the signal lines are needed. However, since the number of the wirings becomes large accompanied in addition to the pixels being highly minute, it is difficult to secure sufficient pitches between the wirings.

On the other hand, in the liquid crystal display device using the polycrystalline silicon TFT, the driving performance of the pixel transistor is high, and hence the signal line driving circuit and the scanning line driving circuit can be formed integrally with each other on the array substrate in the same process as that used in manufacturing the pixel transistor. In this case, part of the signal line driving circuit, for example, a digital-to-analog converter, is provided in the form of a TCP on the outside of the array substrate.

In the liquid crystal display device using the polycrystalline silicon TFT, when compared with that using the amorphous silicon TFT, the number of the wirings for connecting the TCP and the array substrate can be reduced greatly and the liquid crystal display device can be made low cost by reducing the number of external connection components. On the other hand, in the liquid crystal display device using the polycrystalline silicon TFT, the length of the wiring laid on the array substrate becomes longer in accordance with larger size of the array substrate, and video signals are deteriorated, so that display unevenness may occur.

SUMMARY OF THE INVENTION

An object of the present invention is to provide a liquid crystal display device capable of preventing the occurrence of vertical cross talk, horizontal cross talk and flicker.

Another object of the present invention is to provide a liquid crystal display device capable of securing an adequate pitch between wirings, even with developments in highly minute pixels, and of preventing display unevenness due to increased lengths of wirings on the array substrate.

A characteristic point of the present invention is, a liquid crystal display device includes a plurality of pixel transistors respectively connected to corresponding signal lines and corresponding scanning lines at intersection portions of a plurality of the signal lines and a plurality of the scanning lines; pixel electrodes respectively connected to corresponding pixel transistors at the intersection portions; and a signal line driving circuit configured to output video signals to the pixel electrodes via the signal lines so that the polarities of video signals supplied to pixel electrodes adjacent to an arbitrary pixel electrode on both sides thereof in a horizontal scanning direction are different from each other and the polarities of video signals supplied to pixel electrodes adjacent to the arbitrary pixel electrode on both sides thereof in a vertical scanning direction are different from each other.

Another characteristic point of this invention is, the signal line driving circuit includes a signal line driving IC configured to output the video signals to each signal line group obtained by dividing the plurality of signal lines into the plurality of signal line groups composed of a predetermined number of the signal lines; and a signal line switching circuit configured to switch all of the signal lines in each signal line group sequentially during one horizontal scanning period.

BRIEF DESCRIPTION OF THE DRAWINGS

FIG. 7A is a diagram of polarity distribution illustrating polarities of pixels in an arbitrary n-th frame when a signal line driving method of the first embodiment is used, and FIG. 7B is a diagram of polarity distribution illustrating polarities of the pixels in an (n+1)-th frame relative to FIG. 7A.

FIG. 9A is a diagram of polarity distribution illustrating polarities of pixels in an arbitrary n-th frame when another signal line driving method of the first embodiment is used, and FIG. 9B is a diagram of polarity distribution illustrating polarities of the pixels in the (n+1)-th frame relative to FIG. 9A.

FIG. 1B is a diagram of polarity distribution illustrating polarities of the pixels in the (n+1)-th frame relative to FIG. 11A.

DETAILED DESCRIPTION OF EMBODIMENTS

FIRST EMBODIMENT

A liquid crystal display device of this embodiment adopts, as an example, an active matrix type in which a polycrystalline silicon TFT is used as a pixel transistor, and an effective display area has a diagonal size of 14 inches.

Figure 1A:
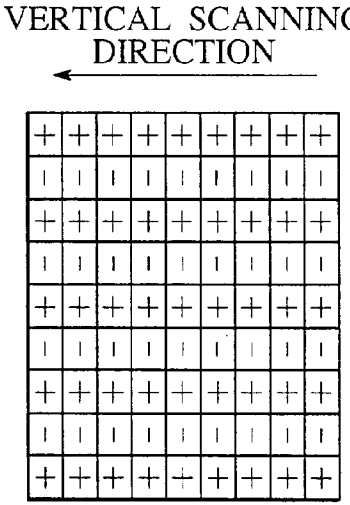
FIG.1A PRIOR ART
FIG. 1A is a diagram of polarity distribution illustrating polarities of pixels in an arbitrary n-th frame when a V-lines inversion driving method is used.
Figure 1B:
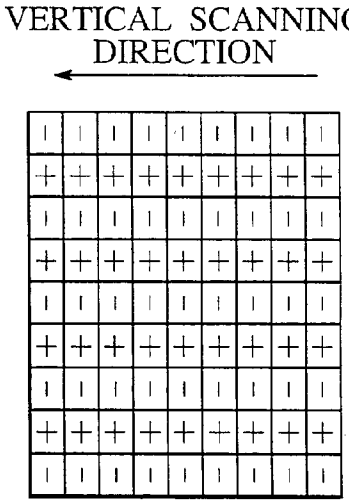
FIG.1B PRIOR ART
FIG. 1B is a diagram of polarity distribution illustrating polarities of the pixels in an (n+1)-th frame relative to FIG. 1A.
Figure 2A:
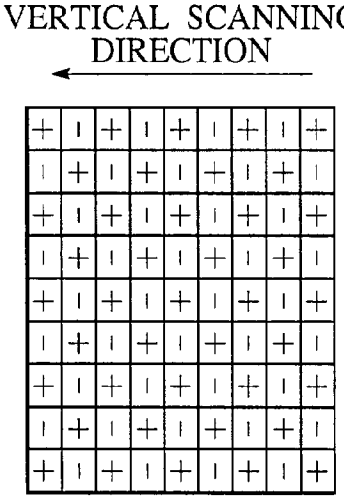
FIG.2A PRIOR ART
FIG. 2A is a diagram of polarity distribution illustrating polarities of pixels in an arbitrary n-th frame when an H/V-lines inversion driving method is used.
Figure 2B:
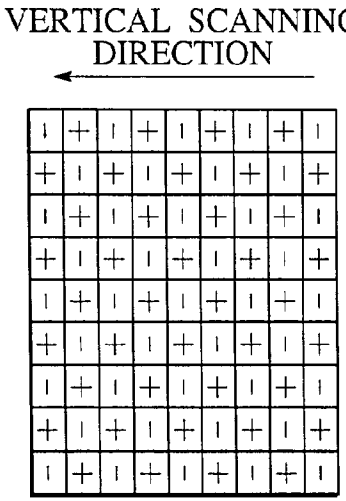
FIG.2B PRIOR ART
FIG. 2B is a diagram of polarity distribution illustrating polarities of the pixels in an (n+1)-th frame relative to FIG. 2A.
Figure 3A:
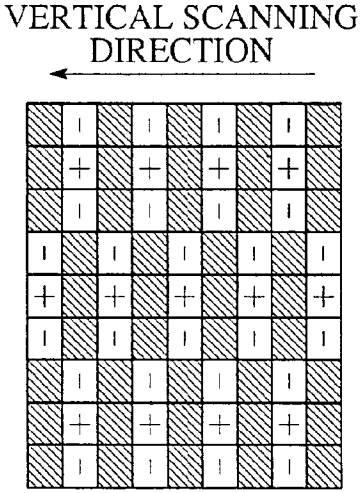
FIG.3A PRIOR ART
FIG. 3A is a diagram of polarity distribution illustrating polarities of pixels in the arbitrary n-th frame when a final screen of OS is displayed by use of the H/V-lines inversion driving method.
Figure 3B:
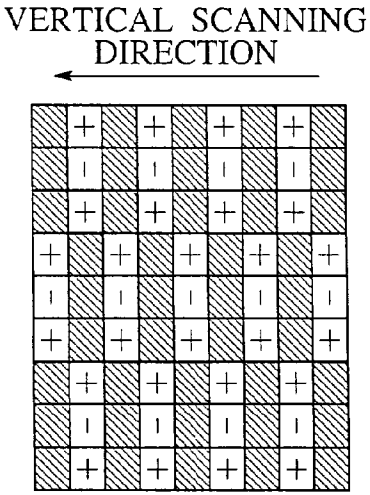
FIG.3B PRIOR ART
FIG. 3B is a diagram of polarity distribution illustrating polarities of the pixels in the (n+1)-th frame relative to FIG. 3A.
Figure 4:
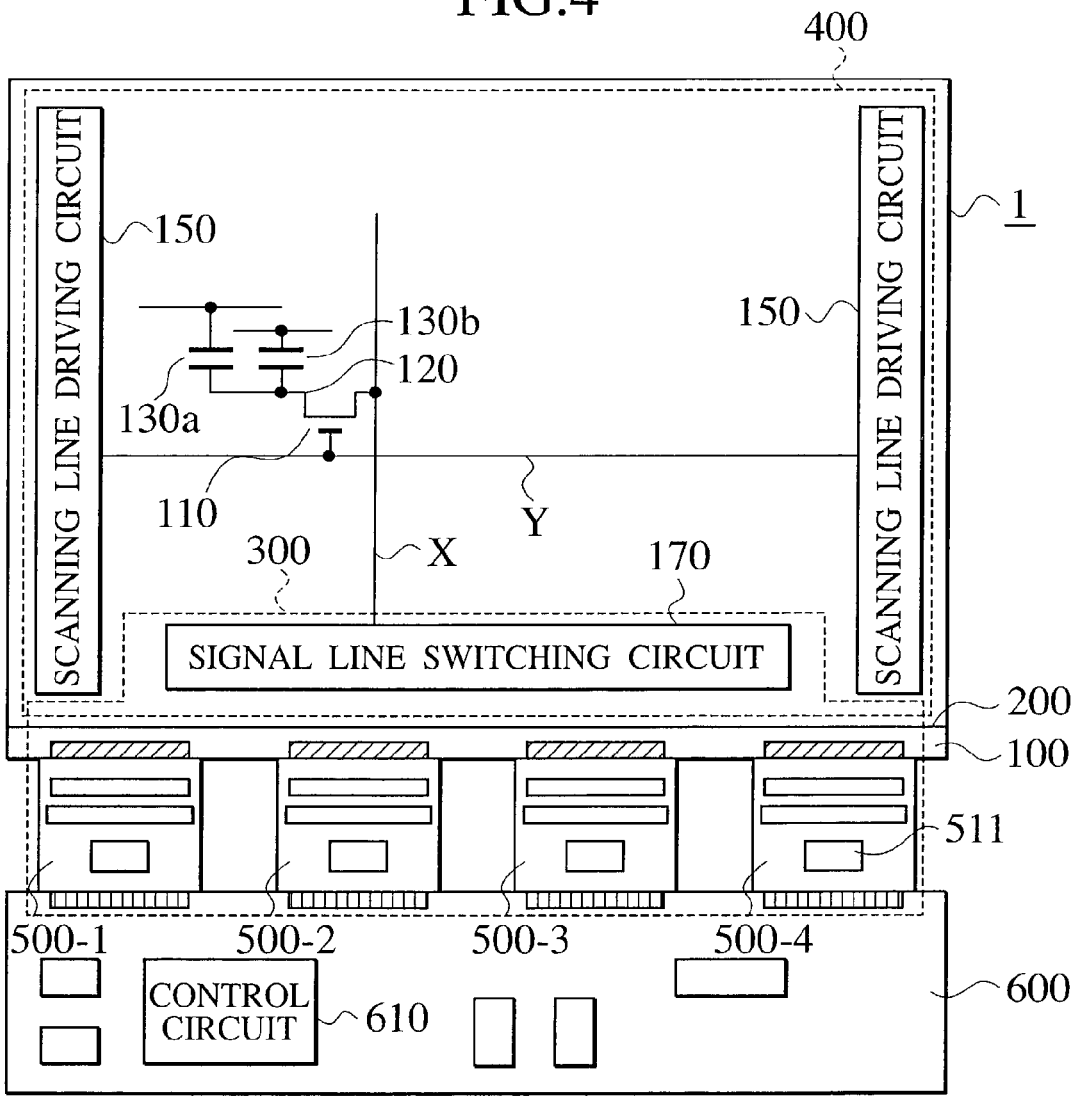
FIG. 4 is a plane view schematically illustrating a constitution of a liquid crystal display device in a first embodiment.

As shown in FIG. 4, this liquid crystal display device 1 comprises an array substrate 100, an opposed substrate 200 disposed so as to face the array substrate 100 with a predetermined interval, and a liquid crystal layer disposed between the array substrate 100 and the opposed substrate 200. The array substrate 100 and the opposed substrate 200 are stuck each other by a sealing member 400.

The array substrate 100 includes a scanning line driving circuit 150, a signal line switching circuit 170, a plurality of scanning lines Y wired in parallel in a horizontal scanning direction (row direction), a plurality of signal lines X wired in parallel in a vertical scanning direction (column direction), a pixel transistor 110 provided at each intersection portion of scanning lines Y and signal lines X, a pixel electrode 120, an auxiliary capacitance element 130*a* and an auxiliary capacitance element 130*b* at each intersection portion.

The pixel transistor 110 is a polycrystalline silicon TFT having a polycrystalline silicon film as a semiconductor layer. A gate electrode of the pixel transistor 110 is connected to the scanning line Y, and a drain electrode thereof is connected to the signal line X. A source electrode of the pixel transistor 110 is connected to the pixel electrode 120. The auxiliary capacitance element 130*a* is formed between the pixel electrode 120 and the array substrate 100, and the auxiliary capacitance element 130*b* is formed between the pixel electrode 120 and the opposed substrate 200.

The scanning line driving circuit 150 supplies a driving signal to the pixel transistor 110 via the scanning line Y The scanning line driving circuit 150 is formed integrally on the array substrate 100 in the same process as that used in manufacturing the pixel transistor 110.

A signal line driving circuit 300 is constituted by TCPs 500-1, 500-2, 500-3, 500-4 (hereinafter, any of the TCPs 500-1 to 500-4 is indicated as a TCP 500-N), which have the same constitution, and the signal line switching circuit 170. TCP 500-N is connected electrically to a connection terminal of the array substrate 100, and the signal line switching circuit 170 is formed on the array substrate 100 in the same process as that used in manufacturing the pixel transistor 110. The signal line driving circuit 300 outputs a video signal while controlling a polarity of the video signal, as described later.

The TCP 500-N has a constitution in which a signal line driving integrated circuit (IC) 511 and the like are mounted on a flexible wiring substrate. One side of the TCP 500-N is electrically connected to one side of the array substrate 100, and the other side thereof is connected to an external printed circuit board (PCB) 600.

On the PCB 600, mounted are a power source circuit, and a control circuit 610. The control circuit 610 outputs a clock signal, various control signals, and the video signal in synchronization with the clock signal.

Figure 5:
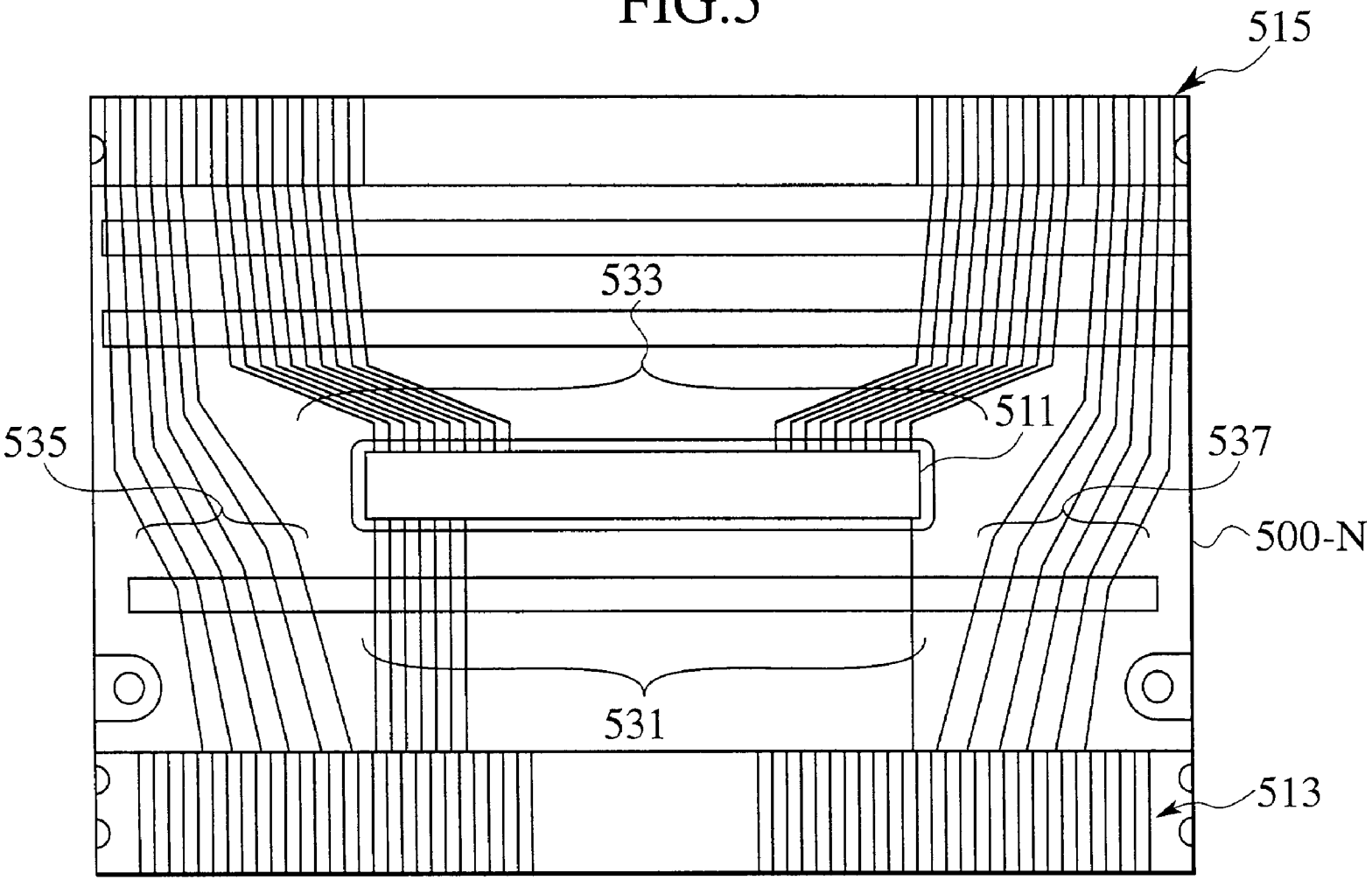
FIG. 5 is a plane view schematically illustrating a constitution of TCP 500-N used in the liquid crystal display device illustrated in FIG. 4.

As shown in FIG. 5, TCP 500-N includes a PCB-side pad 513 connected to a connection terminal of the PCB 600, an array-side pad 515 connected to a connection terminal of the array substrate 100, and various wirings 531, 533, 535 and 537 for connecting these pads. The PCB-side pad 513 and the array-side pad 515 are electrically connected to the PCB 600 and the array substrate 100 via an isotropic conductive film, respectively. The signal line driving IC 511 outputs the video signal to the signal line switching circuit 170.

Figure 6:
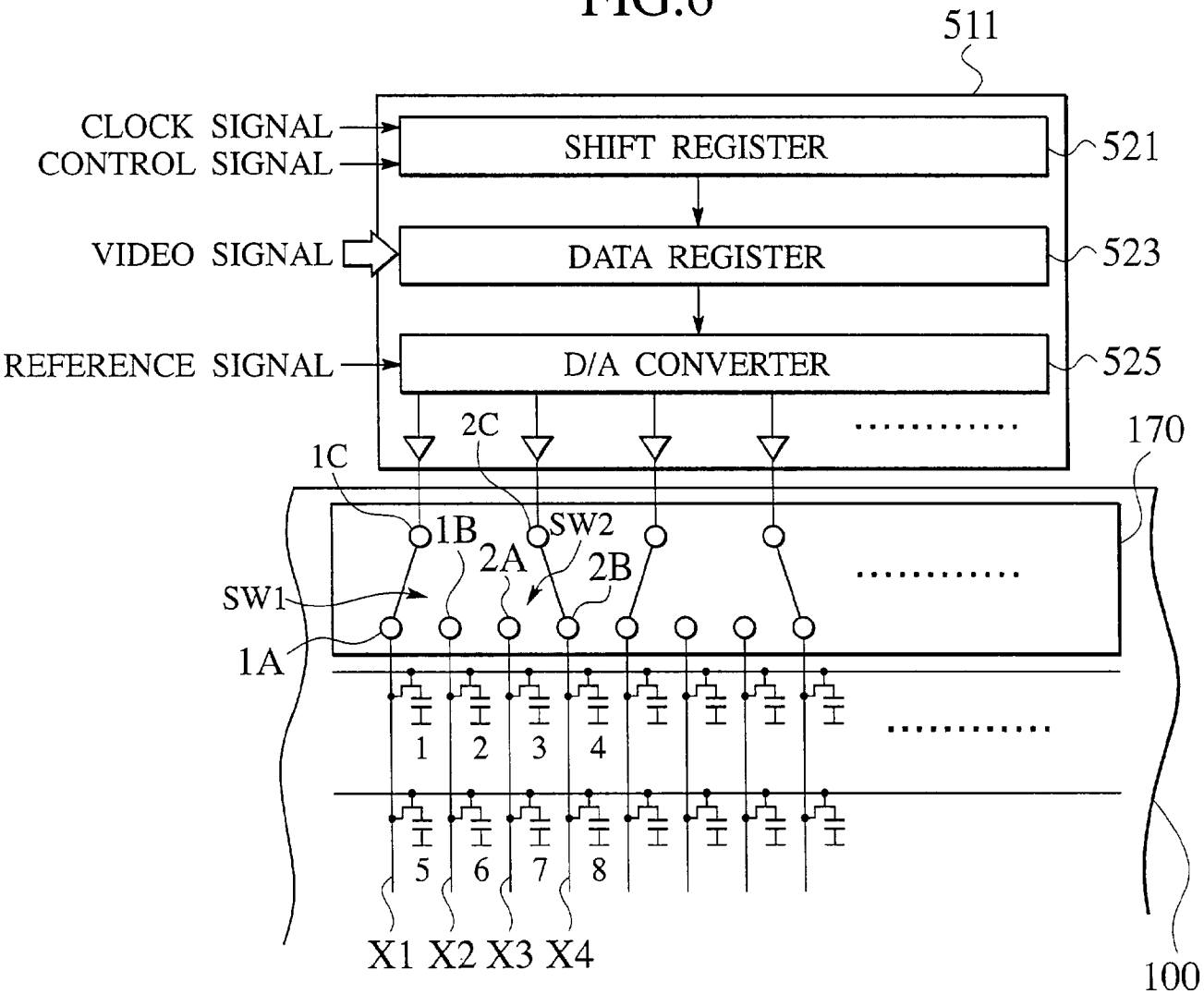
FIG. 6 is a circuit diagram schematically illustrating constitutions of a signal line driving IC and a signal line switching circuit used in the liquid crystal display device illustrated in FIG. 4.

As shown in FIG. 6, the signal line driving IC 511 includes shift register 521, data register 523, digital to analog (D/A) converter 525. The shift register 521 shifts the clock signal and the control signals sent from the PCB 600. The data register 523 stores the video signal temporarily. The D/A converter 525 converts a digital signal to an analog signal with respect to the video signal, and outputs the analog signal to the signal line switching circuit 170. At this time, the signal line driving IC 511 controls the polarity of the video signal, and outputs the video signal to each signal line group obtained by dividing the plurality of signal lines into the plurality of signal line groups composed of a predetermined number of the signal lines. Here, the predetermined number shall be set to 2.

The signal line switching circuit 170 sequentially switches all of the signal lines in each signal line group during one horizontal scanning period. As a concrete constitution, the signal line switching circuit 170 includes input terminals 1C, 2C, . . . , to which the video signals sent from the signal line driving IC 511 are respectively inputted; output terminals 1A, 1B, 2A, 2B, . . . , which are respectively connected to the signal lines X1, X2, X3, X4, . . . ; and switches SW1, SW2, . . . . The SW1 switches the output terminal, between 1A and 1B, so as to selectively connect one of the output terminals 1A and 1B to the input terminal IC. The switch SW2 switches the output terminal, between 2A and 2B, so as to selectively connect one of the output terminals 2A and 2B to the input terminal 2C. Note that in FIG. 6, the pixels in the scanning line positioned in the uppermost step are shown as the pixels 1, 2, 3 and 4, and the pixels in the scanning line in the step second from the top are shown as the pixels 5, 6, 7 and 8.

Next, a driving method of the signal lines will be described. As shown in FIGS. 7A and 7B, in this driving method, the polarities of video signals supplied to pixel electrodes, which are adjacent to any pixel electrode on both sides thereof in a horizontal scanning direction, are controlled so that they are different from each other, and the polarities of video signals supplied to pixel electrodes, which are adjacent to any pixel electrode on both sides thereof in a vertical scanning direction, are controlled so that they are different from each other. Also as to FIGS. 7A and 7B, the pixels in the uppermost row are indicated as the pixels 1, 2, 3 and 4, and the pixels in the row second from the top are indicated as the pixels 5, 6, 7 and 8.

Figure 8:
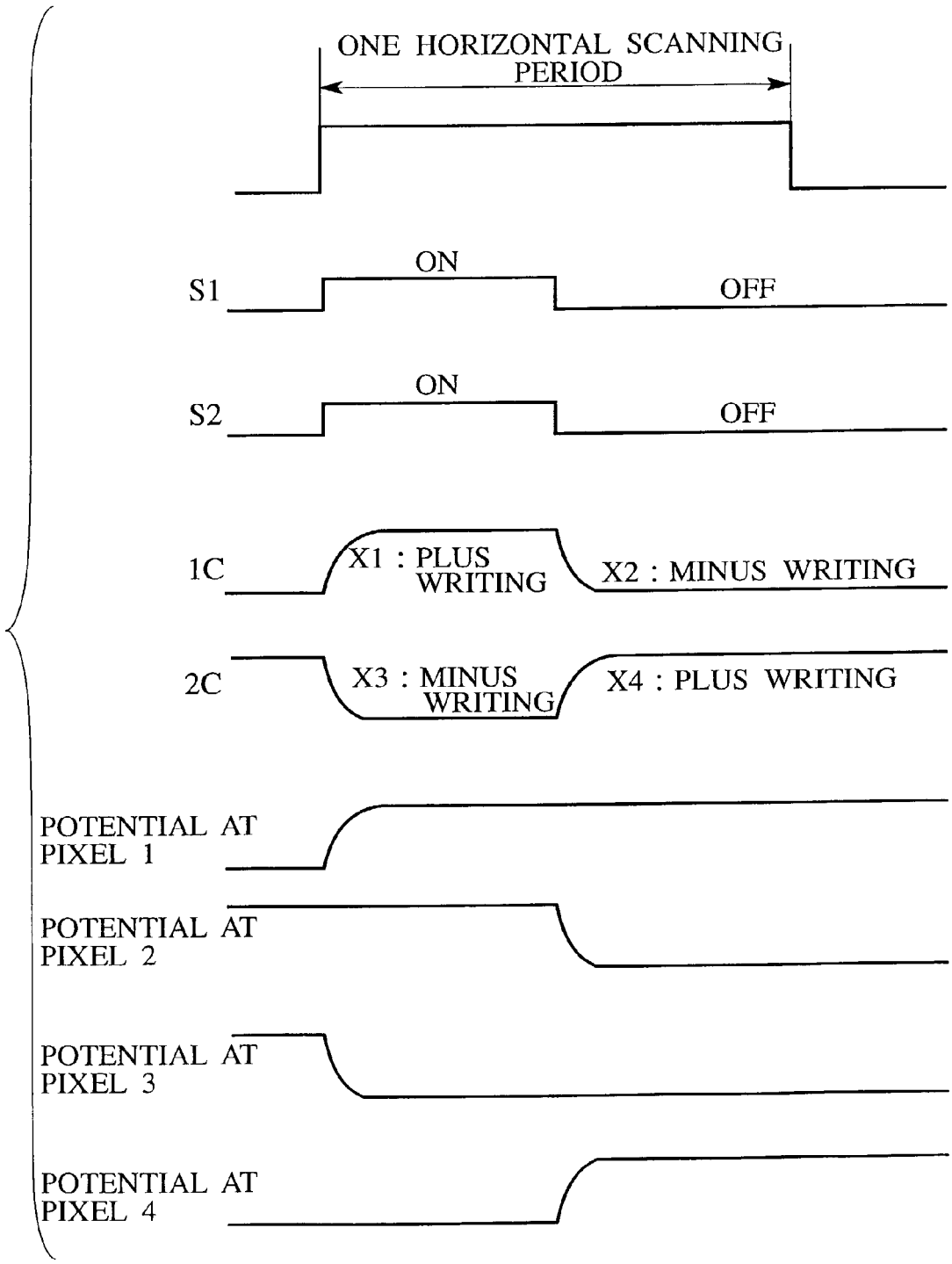
FIG. 8 is a timing chart illustrating an example of processing when a video signal is written to each pixel of FIG. 7A.

In this driving method, in one horizontal scanning period for the uppermost row of the n-th frame, as shown in FIG. 8, a switching signal S1, which is on during the first half of one horizontal scanning period and off during the second half thereof, is inputted to the switch SW1. Thus, the input terminal 1C is connected to the output terminal 1A during the first half of one horizontal scanning period, and is connected to the output terminal 1B during the second half thereof.

Furthermore, a switching signal S2, which is on during the first half of one horizontal scanning period and off during the second half thereof, is inputted to the switch SW2. Thus, the input terminal 2C is connected to the input terminal 2A during the first half of one horizontal scanning period, and is connected to the input terminal 2B during the second half thereof.

At this time, the signal line driving IC 511 outputs the video signal to the input terminal 1C during the first half of one horizontal scanning period, which is to be outputted onto the signal line X1, and outputs the video signal to the input terminal 1C during the second half thereof, which is to be outputted onto the signal line X2. The polarity of the video signal is positive during the first half of one horizontal scanning period, and negative during the second half thereof. The signal line switching circuit 170 outputs the video signal of the positive polarity onto the signal line X1 via the output terminal 1A during the first half of one horizontal scanning period, and outputs the video signal of the negative polarity onto the signal line X2 via the output terminal 1B during the second half thereof.

The signal line driving IC 511 outputs the video signal to the input terminal 2C during the first half of one horizontal scanning period, which is to be outputted onto the signal line X3, and outputs the video signal to the input terminal 2C during the second half thereof, which is to be outputted onto the signal line X4. The polarity of the video signal is negative during the first half of one horizontal scanning period, and positive during the second half thereof. The signal line switching circuit 170 outputs the video signal of the negative polarity onto the signal line X3 via the output terminal 2A during the first half of one horizontal scanning period, and outputs the video signal of the positive polarity onto the signal line X4 via the output terminal 2B during the second half thereof.

Thus, as shown in FIG. 7A, the video signal of the positive polarity is written to the pixel 1 and stored therein, and the video signal of the negative polarity is written to the pixel 2 and stored therein. Moreover, the video signal of the negative polarity is written to the pixel 3 and stored therein, and the video signal of the positive polarity is written to the pixel 4 and stored therein. After that, the similar processing is done for pixels in other rows, whereby the polarity distribution of the pixels as shown in FIG. 7A is obtained. The polarities of all pixels are inverted when the scanning shifts from the n-th frame to the (n+1)-th frame shown in FIG. 7B.

By the described manner, it is possible to make it hard to visually recognize display deterioration due to variations of the potential of pixel electrodes.

Furthermore, the polarity distribution of the pixels as shown in FIGS. 9A and 9B, for example, may be adopted instead of the polarity distribution shown in FIGS. 7A and 7B. Also in this case, the polarities of video signals supplied to pixel electrodes, which are adjacent to any pixel electrode on both sides thereof in a horizontal scanning direction, are controlled so that they are different from each other, and the polarities of video signals supplied to pixel electrodes, which are adjacent to any pixel electrode on both sides thereof in a vertical scanning direction, are controlled so that they are different from each other.

Figure 10:
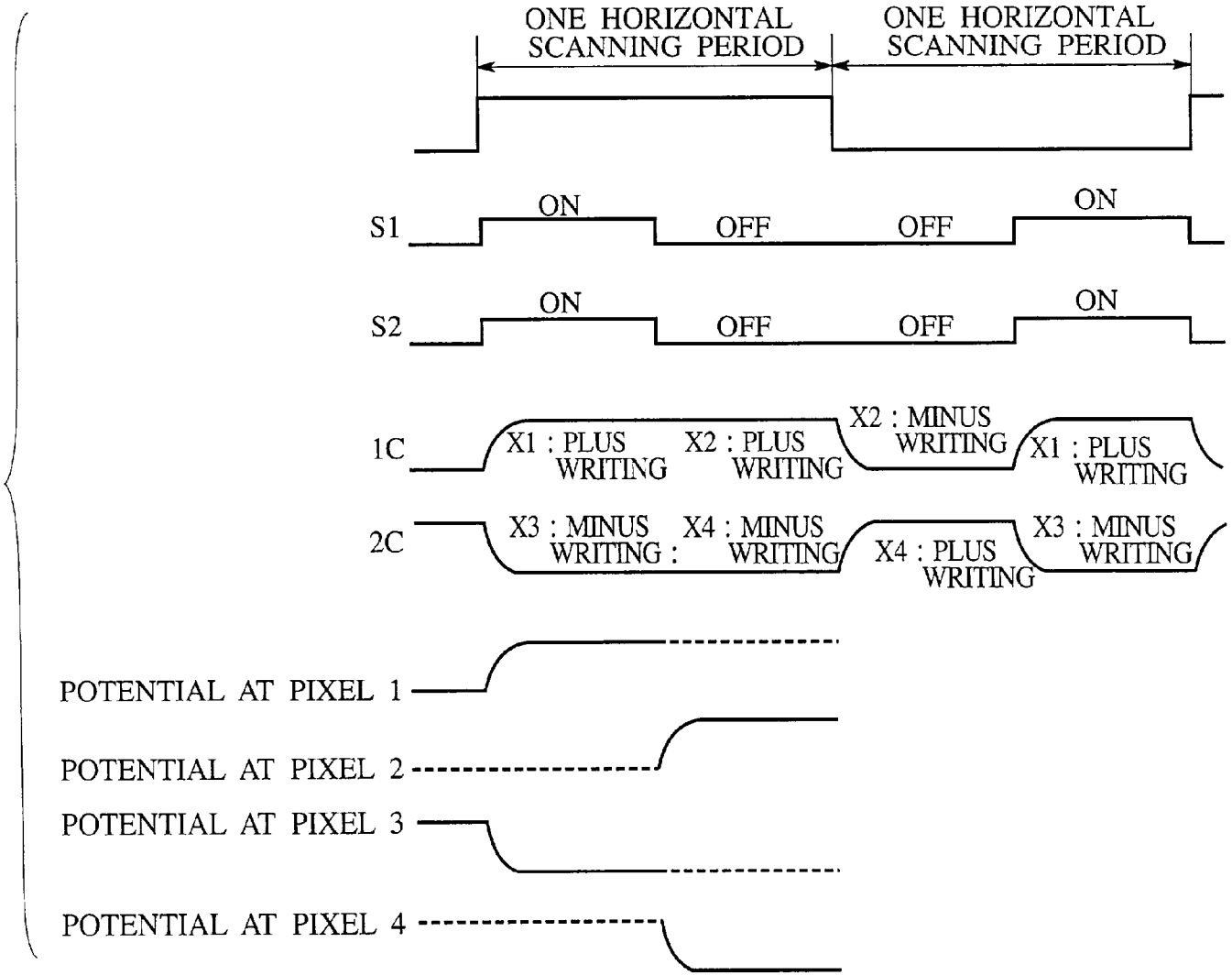
FIG. 10 is a timing chart illustrating an example of processing when a video signal is written to each pixel of FIG. 9A.

During one horizontal scanning period for the uppermost row of the n-th frame in this case, as shown in FIG. 10, the switching signal S1, which is on during the first half of one horizontal scanning period and off during the second half thereof, is inputted to the switch SW1, and the switching signal S2 similar to the switching signal S1 is inputted to the switch SW2. Thus, the input terminal 1C of the signal line switching circuit 170 is connected to the output terminal 1A during the first half of one horizontal scanning period, and is connected to the output terminal 1B during the second half thereof. The input terminal 2C is connected to the output terminal 2A during the first half of one horizontal scanning period, and is connected to the output terminal 2B during the second half thereof.

The signal line driving IC 511 outputs the video signal of the positive polarity to the input terminal 1C during both of the first and second halves of one horizontal scanning period. The signal line switching circuit 170 outputs the video signal of the positive polarity to the signal line X1 via the output terminal 1A during the first half of one horizontal scanning period, and outputs the video signal of the positive polarity to the signal line X2 via the output terminal 1B during the second half thereof.

The signal line driving IC 511 outputs the video signal of the negative polarity to the input terminal 2C during both of the first and second halves of one horizontal scanning period. The signal line switching circuit 170 outputs the video signal of the negative polarity to the signal line X3 via the output terminal 2A during the first half of one horizontal scanning period, and outputs the video signal of the negative polarity to the signal line X4 via the output terminal 2B during the second half thereof.

Thus, as shown in FIG. 9A, the video signal of the positive polarity is written to the pixel 1 and stored therein, and the video signal of the positive polarity is written to the pixel 2 and stored therein. Moreover, the video signal of the negative polarity is written to the pixel 3 and stored therein, and the video signal of the negative polarity is written to the pixel 4 and stored therein.

Subsequently, during one horizontal scanning period for the second row of the n-th frame, the switching signal S1 becomes off during the first half of one horizontal scanning period and becomes on during the second half thereof. The switching signal S1 is inputted to the switch SW1, and the input terminal 1C is retained to be connected to the output terminal 1B during the first half of one horizontal scanning period, and connected to the output terminal 1A during the second half thereof. Also the switching signal S2 becomes off during the first half of one horizontal scanning period, and becomes on during the second half thereof. The switching signal S2 is inputted to the switch SW2, and the input terminal 2C is retained to be connected to the output terminal 2B during the first half of one horizontal scanning period, and connected to the output terminal 2A during the second half thereof.

The signal line driving IC 511 outputs the video signal of the negative polarity to the input terminal 1C during the first half of one horizontal scanning period. The signal line switching circuit 170 outputs this video signal to the signal line X2 via the output terminal 1B. During the second half of one horizontal scanning period, the signal line driving IC 511 outputs the video signal of the positive polarity to the input terminal 1C, and the signal line switching circuit 170 outputs this video signal to the signal line X1 via the output terminal 1A.

Similarly, the signal line driving IC 511 outputs the video signal of the positive polarity to the input terminal 2C during the first half of one horizontal scanning period. The signal line switching circuit 170 outputs this video signal to the signal line X4 via the output terminal 2B. During the second half of one horizontal scanning period, the signal line driving IC 511 outputs the video signal of the negative polarity to the input terminal 2C, and the signal line switching circuit 170 outputs this video signal to the signal line X3 via the output terminal 2A.

Thus, as shown in FIG. 9A, the video signal of the positive polarity is written to the pixel 5 and stored therein. The video signal of the negative polarity is written to the pixel 6 and stored therein. Moreover, the video signal of the negative polarity is written to the pixel 7 and stored therein. The video signal of the positive polarity is written to the pixel 8 and stored therein.

After that, the similar processing is done for pixels in other rows, whereby the polarity distribution of the pixels as shown in FIG. 9A is obtained. The polarities of all pixels are inverted when the scanning shifts from the n-th frame to the (n+1)-th frame shown in FIG. 9B.

By the described manner, it is possible to make it hard to visually recognize display deterioration due to variations of the potential of pixel electrodes.

Figure 11A:
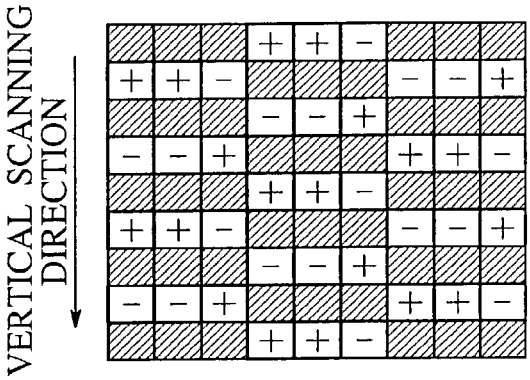
FIG. 11A is a diagram of polarity distribution illustrating polarities of pixels in an arbitrary n-th frame when a final screen of OS is displayed by use of the polarity distribution of FIG. 7A.
Figure 11B:
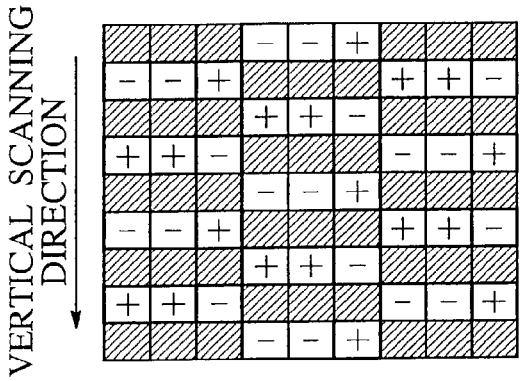

As shown in FIGS. 11A and 11B, when a final screen of Windows (trade mark) is displayed by the driving method of this embodiment, the number of positive polarity pixels and the number of negative polarity pixels in the halftone display pixels are equal and show no polarity deflection in one horizontal scanning period. Furthermore, since the number of positive polarity pixels and the number of negative polarity pixels in the halftone display pixels of the n-th and (n+1)-th frames are approximately equal and show no polarity deflection.

As described above, in this embodiment, the polarities of video signals supplied to pixel electrodes, which are adjacent to any pixel electrode on both sides thereof in a horizontal scanning direction, are controlled so that they are different from each other, and the polarities of video signals supplied to pixel electrodes, which are adjacent to any pixel electrode on both sides thereof in a vertical scanning direction, are controlled so that they are different from each other. Thus, the polarities of pixels are inverted every two horizontal scanning periods, that is, every two rows, the potential variation of the pixel electrode due to coupling capacitance between the signal line and the pixel electrode is canceled. Accordingly, the occurrence of vertical cross talk can be prevented. Furthermore, since the number of positive polarity pixels and the number of negative polarity pixels are equal and show no polarity deflection in one horizontal scanning period, it is possible to prevent the occurrence of the horizontal cross talk. Furthermore, since the number of positive polarity pixels and the number of negative polarity pixels in the n-th and (n+1)-th frames are equal and show no polarity deflection, flicker does not occur, thus achieving good display quality. In addition, since the cycle of the inversion of the video signal between the positive and negative polarities in the vertical scanning direction is two horizontal scanning periods, power consumption is more suppressed compared to the H/V-lines inversion driving method.

In this embodiment, the video signal is outputted by the signal line driving IC 511 to each signal line group obtained by dividing the plurality of signal lines into the plurality of signal line groups composed of two signal lines, and the two signal lines in each signal line group are sequentially switched in one horizontal scanning period by the signal line switching circuit 170. Thus, since the number of the wirings for transmitting the video signals to the signal switching circuit 170 can be reduced to be less than the number of the signal lines even when the pixels are made to be minute, the pitch of the wirings can be fully secured. Furthermore, since the number of the output terminals for the video signal in the signal line driving IC 511 can be reduced to be less than the number of signal lines, the number of the signal line driving ICs 511 can be reduced, and a decrease in cost can be achieved.

In this embodiment, the signal line driving IC 511 is mounted on the flexible wiring substrate, and the flexible wiring substrate is electrically connected to the connection terminal of the array substrate 100. Furthermore, the signal switching circuit 170 is integrally formed on the array substrate 100 in the same process as that used in manufacturing the pixel transistor 110. Thus, deterioration of the video signal due to increased lengths of wirings can be prevented compared to the case where all of the circuits constituting the signal line driving circuit 300 are formed on the array substrate 100.

In this embodiment, the two output terminals are provided for one input terminal in each switch SW of the signal line switching circuit 170, and the video signal is outputted by switching the two output terminals. However, the way to output the video signal is not limited to this. For example, the number of the input terminals can be reduced to ¼ of the number of the signal lines. In this case, four output terminals are provided for one input terminal, and four signal lines in each signal line group is sequentially switched during one horizontal scanning period.

Finally, a detailed constitution of the TCP 500-N will be described supplementary. As shown in FIG. 5, the TCP 500-N includes an input signal wiring group 531 provided so as to correspond with the number of input signals from the PCB 600 to the signal line driving IC 511, an output signal wiring group 533 provided so as to correspond with the number of output signals from the signal line driving IC 511, and wiring groups 535 and 537 composed of a power source wiring for the liquid crystal display device, power source wirings for the switches SW of the signal line switching circuit 170, wirings for the switching signals S and the like.

The input signal wiring group 531 and the output signal wiring group 533 are disposed between the wiring groups 535 and 537 in which the wirings are distributed to the approximately equal numbers. The wiring groups 535 and 537 form a power source wiring and a control signal wiring leading to the scanning line driving circuits 150 respectively provided on both ends of the array substrate 100. As a matter of course, when the scanning driving circuit 150 is provided only on one end of the array substrate 100, the power source wiring and the control signal line may be provided for either the TCP 500-1 or TCP 500-4 which corresponds to this one end of the array substrate 100.

As described above, wiring members newly need not to be prepared and cost can be reduced by forming the power source wiring for the scanning line driving circuit 150, the wiring for the control signal, the power source wiring for the switch SW of the signal line switching circuit 170, the wiring for the switching signal S, and the power source wiring for the liquid crystal display device on the TCP 500-N along with the input signal wiring and output signal wiring of the signal line driving IC 511.

SECOND EMBODIMENT

In a second embodiment, description will be made for a liquid crystal display device for preventing display unevenness due to potential variations of pixels. Since the basic constitution of the liquid crystal display device and a driving method thereof in this embodiment are the same as those of the first embodiment, duplicate explanations for them are omitted here. Moreover, the driving method described in the first embodiment is called a 2H2V-lines inversion method here.

Figure 12:
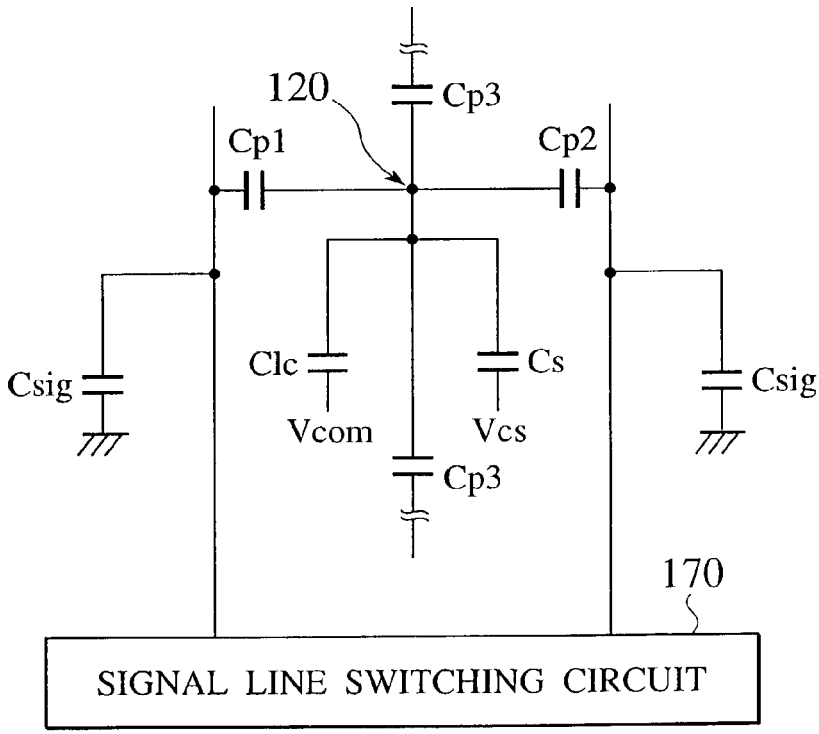
FIG. 12 is a circuit diagram illustrating an equivalent circuit of an arbitrary one pixel in a liquid crystal display device in a second embodiment.

First, potential variations of pixels will be described. The symbols in the equivalent circuit of the pixels shown in FIG. 12 are as follows respectively. Cp1 is coupling capacitance between a pixel and a signal line connected to the pixel. Cp2 is coupling capacitance between a pixel and a signal line connected to another pixel adjacent to the pixel in a horizontal scanning direction. Cp3 is coupling capacitance between a pixel and another pixel adjacent to the pixel in a vertical scanning direction. Clc is liquid crystal capacitance. Cs is auxiliary capacitance. Csig is total capacitance of signal line. Vcom is potential of opposed electrode formed on the surface of the opposed substrate. Vcs is potential of auxiliary capacitance line.

The potential of the pixel undergoes the variation expressed by the following equations.

$$Vs=Cp1/\mathrm{Cload}\times dV\mathrm{sig}.s \quad (1)$$

$$Vn=Cp2/\mathrm{Cload}\times dV\mathrm{sig}.n \quad (2)$$

$$Vv=Cp3/\mathrm{Cload}\times dV\mathrm{pix} \quad (3)$$

Where dVsig.s is a potential variation of the signal line connected to the pixel, dVsig.n is a potential variation of the signal line connected to another pixel adjacent to the pixel in a horizontal scanning direction, dVpix is a potential variation of still another pixel adjacent to the pixel in a vertical scanning direction, and Cload is equal to Cp1+Cp2+2Cp3+Clc+Cs.

Figure 13:
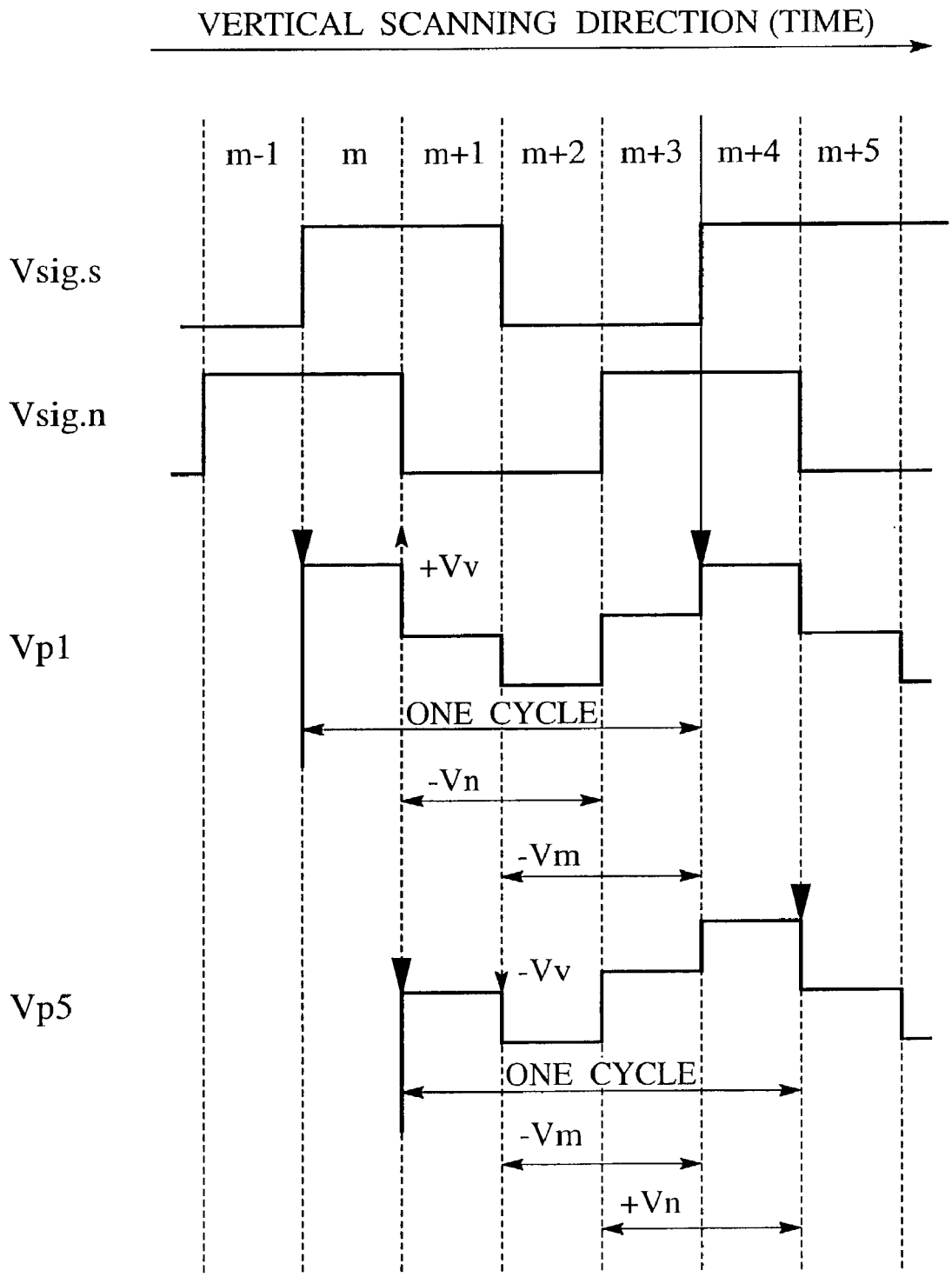
FIG. 13 is a timing chart illustrating an example of an operation of the pixel in the second embodiment.

The potential of the pixel 1 shall be Vp1, and the potential of the pixel 5 adjacent to the pixel 1 in the vertical scanning direction shall be Vp5. The potential variation amount dVp1 of the pixel 1 and the potential variation amount dVp5 of the pixel 5 due to the coupling capacitance between the signal line and each pixel are expressed as follows based on FIG. 13.

$$dVp1=-\tfrac{1}{2}Vn-\tfrac{1}{2}Vs+Vv \quad (4)$$

$$dVp5=\tfrac{1}{2}Vn-\tfrac{1}{2}Vs-Vv \quad (5)$$

The difference dVp of the potential variation amount between the pixel 1 and the pixel 5 is expressed by the following equation.

$$dVp=dVp5-dVp1=Vn-2Vv=Cp2/Cload\times dVsig.n-2\times Cp3/Cload\times dVpix \quad (6)$$

If the value of dVp is large, the difference of the potentials between the pixel 1 and the pixel 5 is large, and display unevenness may be caused. Therefore, dVp=0 should be established.

In the embodiment, in order to allow the value of dVp to approximate zero, a technique to reduce the coupling capacitance Cp2 will be described. Since a basic constitution of the liquid crystal display device and a driving method of the liquid crystal display device in this embodiment are the same as those of the first embodiment, duplicated descriptions are omitted here.

Figure 14:
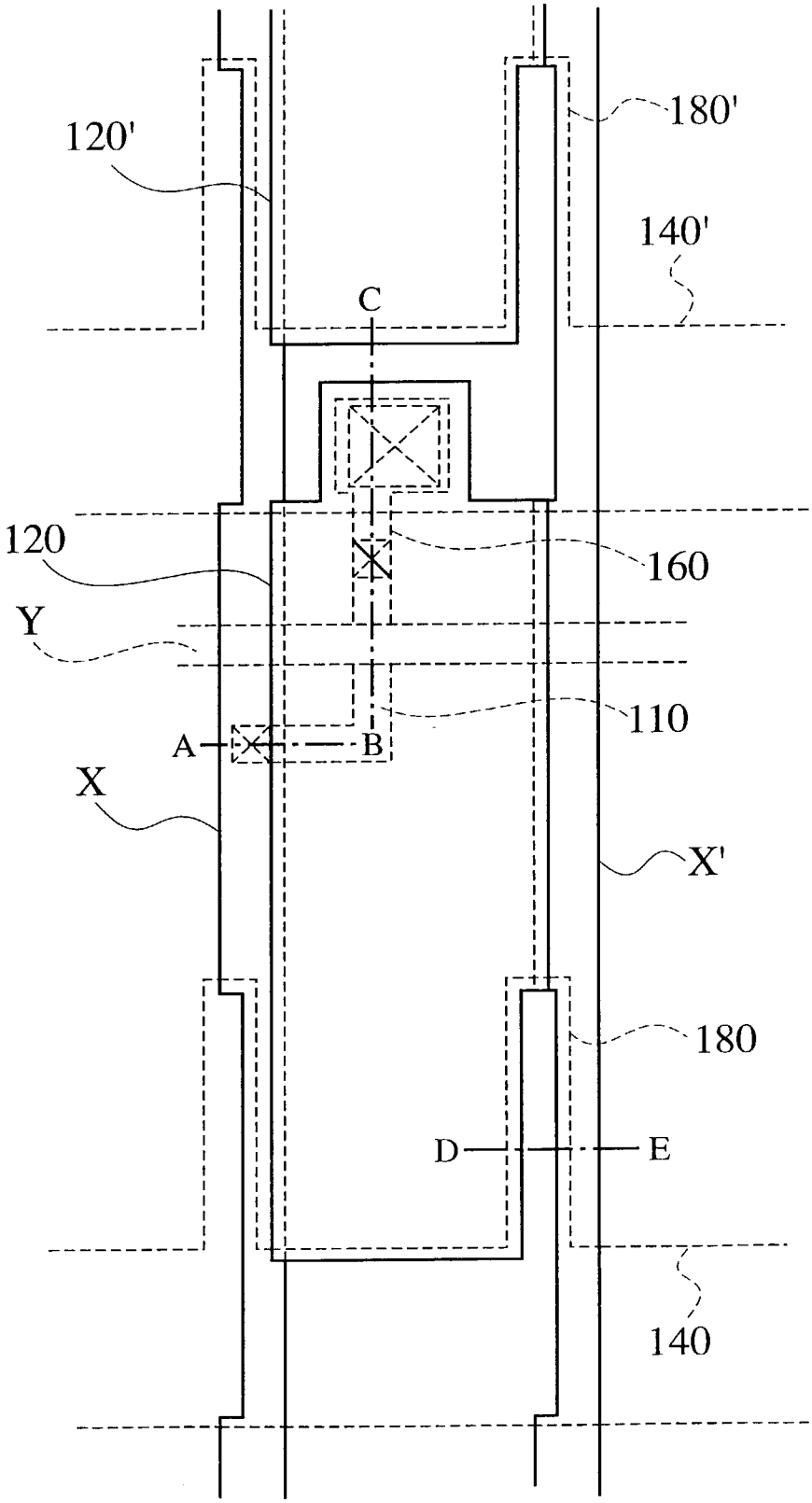
FIG. 14 is a plane view illustrating a positional relationship between a pixel electrode of a liquid crystal display device and a periphery portion thereof in a third embodiment.

As shown in FIG. 14, auxiliary capacitance lines 140 and 140' are disposed in parallel with a scanning line Y A pixel electrode 120 is disposed so as to be surrounded by signal lines X and X' and the auxiliary lines 140 and 140' which are perpendicular to the signal lines X and X'. The pixel electrode 120 is connected to the signal line X via a pixel transistor 110.

A shielding electrode 180 having an electrostatic shielding property is formed at a boundary portion between the pixel electrode 120 and the signal line X'. The shielding electrode 180 is formed by an extension of a part of the auxiliary capacitance line 140 along the signal line X'. With respect to the auxiliary capacitance line 140', a shielding electrode 180' is formed similarly.

Figure 15:
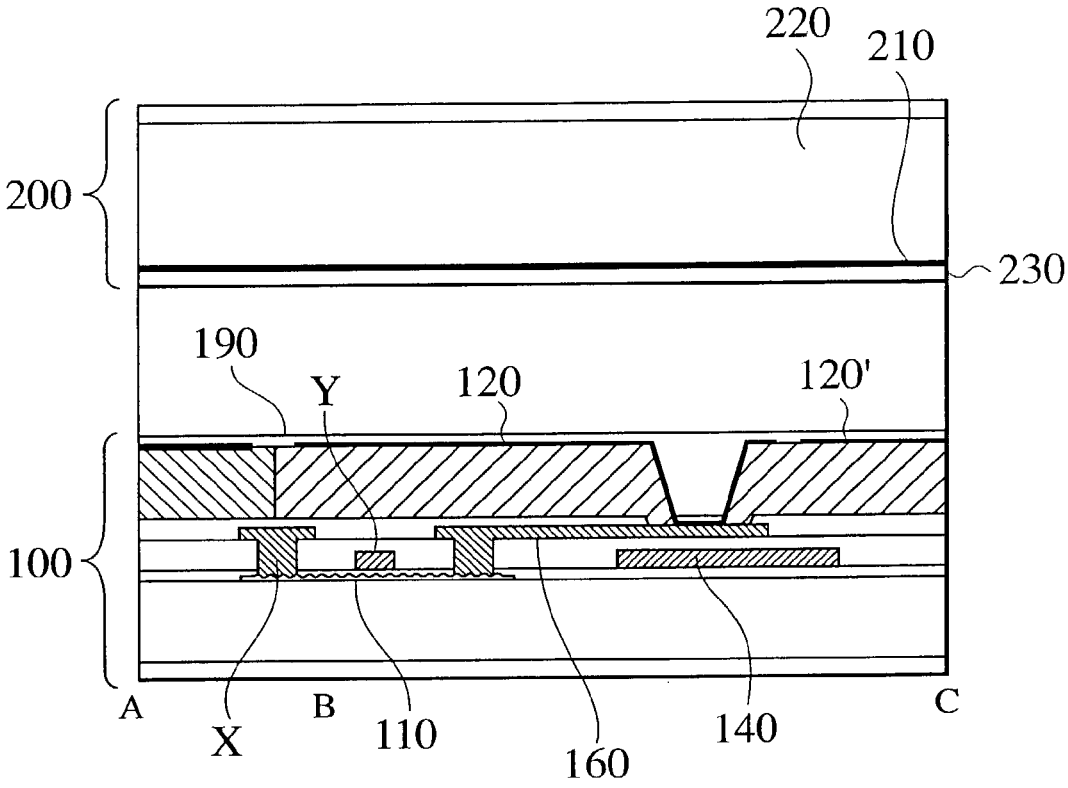
FIG. 15 is a sectional view of a position illustrated by the line A-B-C in FIG. 14.
Figure 16:
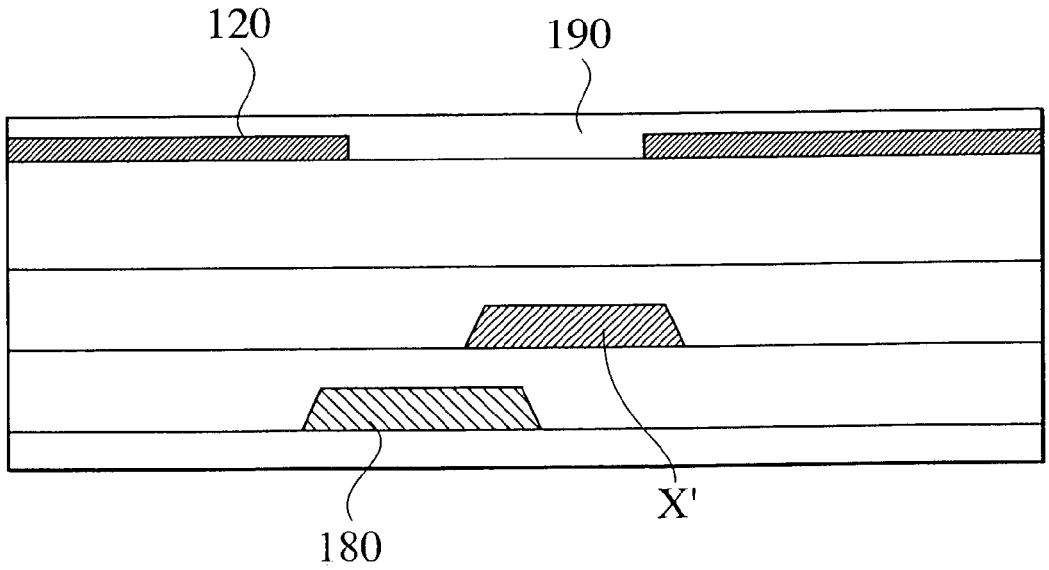
FIG. 16 is a sectional view of a position illustrated by the line D-E in FIG. 14.

In FIG. 15 illustrating a sectional view taken along the line A-B-C of FIG. 14 and in FIG. 16 illustrating a sectional view taken along the line D-E of FIG. 14, reference numeral 160 denotes a source electrode wiring, 190 denotes an alignment film, 210 denotes an opposed electrode, 220 denotes a glass substrate, and 230 denotes an alignment film.

In this liquid crystal display device, so called a shielding effect is caused and the coupling capacitance Cp2 is reduced by applying fixed potentials to the shielding electrodes 180 and 180'. Moreover, the fixed potentials of the shielding electrodes 180 and 180' are regulated so that dVp becomes zero.

Therefore, according to this embodiment, shielding electrode 180 is provided between the pixel electrode 120 and the signal line X, whereby the coupling capacitance Cp2 can be reduced. Thus, the difference dVp of the potential variation amount between the pixels adjacent to each other in the vertical scanning direction can be reduced, and a good display quality can be obtained.

According to this embodiment, the fixed potential applied to the shielding electrode 180 is regulated so that dVp becomes zero, whereby the occurrence of display unevenness can be prevented.

THIRD EMBODIMENT

In this embodiment, by providing an electrostatic capacitor between pixels adjacent to each other in a vertical scanning direction, the coupling capacitance Cp3 is increased and the value of the electrostatic capacitance is regulated so that the value of the difference dVp of the potential variation amount between the pixels adjacent to each other in the vertical scanning direction becomes zero. Since a basic constitution of the liquid crystal display device and a driving method thereof in this embodiment are the same as those of the first embodiment, duplicate descriptions are omitted.

Figure 17:
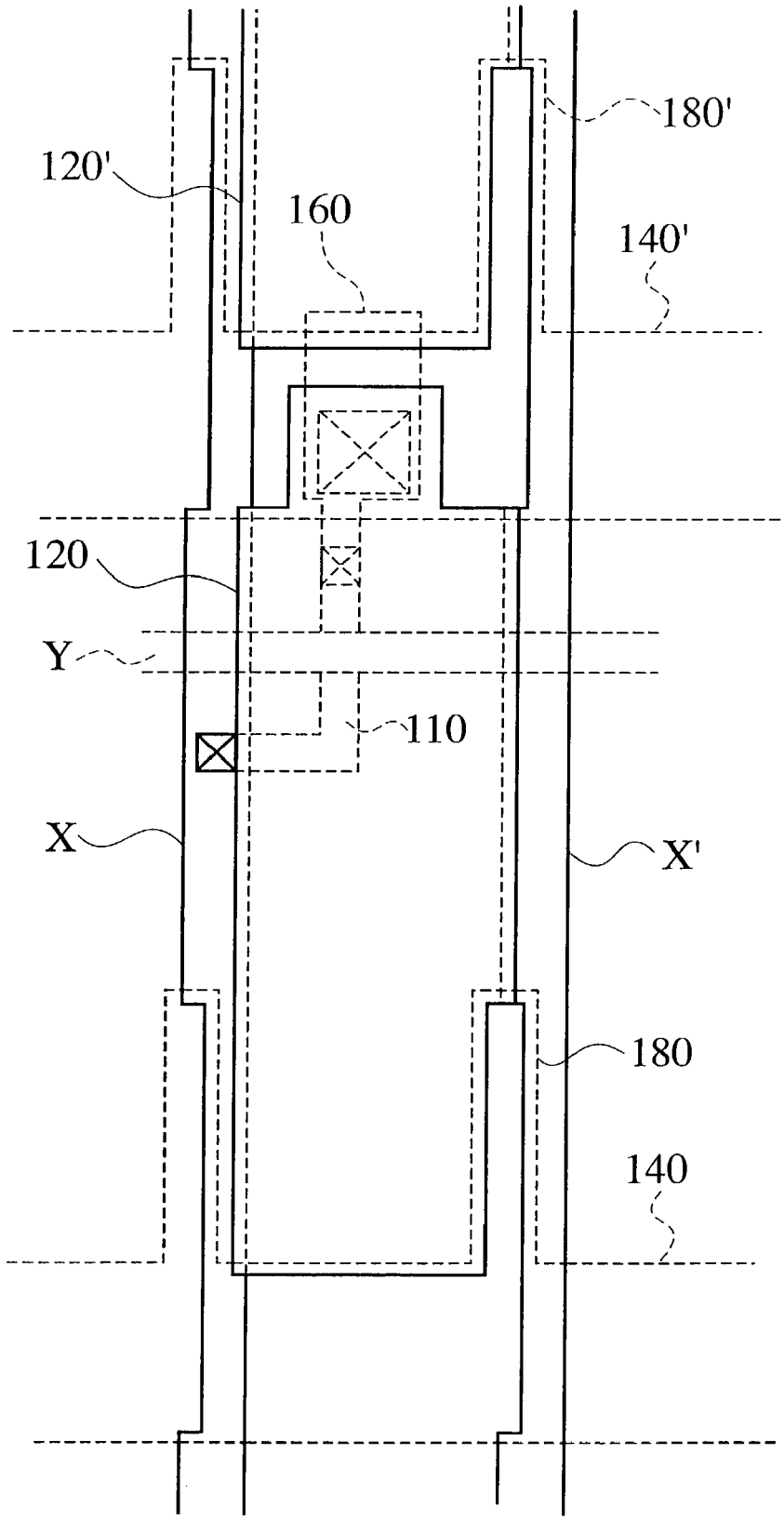
FIG. 17 is a plane view illustrating a positional relationship between a pixel electrode and a periphery portion when an electrostatic capacity is provided between pixel electrodes adjacent to each other in a vertical scanning direction.

As shown in FIG. 17, a source electrode wiring 160 connected to a source electrode of a pixel transistor 110 is extended to a pixel electrode 120' adjacent to a pixel electrode 120 in the vertical scanning direction. Thus, electrostatic capacitance is formed between the pixel electrodes. Note that the same constituent components in FIG. 17 as those in FIG. 14 are marked with the same reference numerals and symbols.

As described above, in this embodiment, providing the electrostatic capacitance between the pixel electrodes adjacent to each other in the vertical scanning direction increases the coupling capacitance Cp3. Thus, the difference dVp can be reduced, and occurrence of display unevenness can be prevented.

Furthermore, according to this embodiment, the value of the electrostatic capacitance is regulated so that the difference dVp of the potential variation amount between the pixels becomes zero, whereby the occurrence of display unevenness can be prevented.

In this embodiment, shielding electrodes 180 and 180' are shown in FIG. 17. In this case, both of the coupling capacitances Cp2 and Cp3 can be adjusted. As a matter of course, only the source electrode wiring 160 without providing the shielding electrodes 180 and 180' may adjust the coupling capacitance Cp3.

What is claimed is:

1. A liquid crystal display device, comprising:

a plurality of pixel transistors respectively connected to corresponding signal lines and corresponding scanning lines at intersection portions of a plurality of the signal lines and a plurality of the scanning lines;

pixel electrodes respectively connected to corresponding pixel transistors at the intersection portions;

a signal line driving IC configured to output video signals whose polarities are inverted in a prescribed cycle to a plurality of respective output terminals; and a signal line switching circuit configured to be connected to the output terminals and output the video signals to the pixel electrodes via the signal lines so that the polarities of video signals supplied to pixel electrodes adjacent to an arbitrary pixel electrode on both sides thereof in a horizontal scanning direction are different from each other and the polarities of video signals supplied to pixel electrodes adjacent to the arbitrary pixel electrode on both sides thereof in a vertical scanning direction are different from each other, said signal line switching circuit configured to select the signal lines according to the same timing as the prescribed cycle and supply the video signals to the selected signal lines.

2. The liquid crystal display device according to claim 1, wherein the predetermined number of the signal lines is two.

3. The liquid crystal display device according to claim 1, wherein the signal line driving IC is mounted on a flexible substrate electrically connected to a connection terminal of an array substrate, and the signal line switching circuit is formed integrally on the array substrate in the same process as that used in manufacturing the pixel transistors.

4. The liquid crystal display device according to claim 1, wherein shielding electrodes are respectively formed at boundary portions between the pixel electrodes and the signal lines.

5. The liquid crystal display device according to claim 4, further comprising auxiliary capacitance lines being wired in parallel with the scanning lines, the shielding electrode being formed by an extension of the auxiliary capacitance line along the signal line.

6. The liquid crystal display device according to any one of claims 1 and 2 to 5, wherein an electrostatic capacitance is formed between the pixel electrodes adjacent to each other in the vertical scanning direction.

7. The liquid crystal display device according to claim 6, further comprising a source electrode wiring being connected to a source electrode of the pixel transistor, the electrostatic capacitance is formed by an extension of the source electrode wiring to a position between the pixel electrodes.

* * * * *